US005676203A

United States Patent [19]

Kajikawa et al.

[11] Patent Number: 5,676,203

[45] Date of Patent: Oct. 14, 1997

[54] HEAT EXCHANGER

[75] Inventors: Syunji Kajikawa, Ama-gun; Munenori Yuasa, Chiryu; Yasuaki Isobe, Nagoya; Hiroshi Ikeda, Nagoya; Yuji Suzuki, Nagoya, all of Japan

[73] Assignee: Nippondenso Co., Ltd., Kariya, Japan

[21] Appl. No.: 491,806

[22] Filed: Jun. 19, 1995

[30] Foreign Application Priority Data

Jun. 20, 1994 [JP] Japan ..... 6-137662

[51] Int. Cl.[6] ..... F28F 3/08

[52] U.S. Cl. ..... 165/167; 165/134.1; 165/916; 123/196 AB

[58] Field of Search ..... 165/916, 134.1, 165/167; 123/196 AB

[56] References Cited

U.S. PATENT DOCUMENTS

| | | | |
|---|---|---|---|
| 5,011,547 | 4/1991 | Fujimoto et al. | 165/134.1 X |
| 5,078,209 | 1/1992 | Kerkman et al. | 165/916 X |
| 5,099,912 | 3/1992 | Tajima et al. | 165/916 X |

FOREIGN PATENT DOCUMENTS

| | | | |
|---|---|---|---|
| 551 545 | 7/1993 | European Pat. Off. . | |
| 0563951 | 10/1993 | European Pat. Off. | 165/916 |
| 5 1890 | 1/1993 | Japan . | |
| 5332692 | 12/1993 | Japan . | |

*Primary Examiner*—John Rivell
*Assistant Examiner*—Christopher Atkinson
*Attorney, Agent, or Firm*—Cushman, Darby & Cushman IP Group of Pillsbury Madison & Sutro LLP

[57] ABSTRACT

A water-cooled oil cooler includes a laminated body formed by alternately piling up formed plates having cooling water passage openings and oil passage openings in the direction of plate thickness, and fin plates having cooling water passage openings and oil passage openings in the direction of plate thickness. A protrusion is projected from a passage wall of the cooling water passage opening of the fin plate into a cooling water passage. By setting the protrusion baser than the other part of the fin plate, the protrusion is made to serve as a sacrificial corrosion section to prevent the contact section from being precedently corroded.

8 Claims, 5 Drawing Sheets

HEAT EXCHANGER

CROSS REFERENCE TO RELATED APPLICATION

This application is based upon and claims priority from Japanese Patent Application No. Hei 6-137662 filed Jun. 20, 1994, the contents of which are incorporated herein by reference.

BACKGROUND OF THE INVENTION

1. Field of the Invention

The present invention relates to a heat exchanger which is so designed that several of a plurality of metal plates serve as a sacrificial corrosion material.

2. Description of the Related Art

Conventional aluminum heat exchangers, performing heat exchange between cooling water and another fluid (engine oil or air), have a cooling water passage formed by surfaces of aluminum alloy plates. The passage wall of the cooling water passage is clad with a sacrificial corrosion material for preventing pitting corrosion from occurring at the passage wall, which would reduce the life of heat exchangers.

Aluminum heat exchangers (e.g., a heat exchanger disclosed in Japanese Unexamined Patent Application No. Hei 5-332692) are known in which a plurality of metal plates having first and second through-holes, arranged in the direction of thickness, are laminated in the direction of plate thickness to form a cooling water passage by aligning the first through-holes in the direction of lamination and to form an oil passage by aligning the second through-holes in the direction of lamination.

Since the passage wall of a cooling water passage formed in the direction of plate thickness in a plurality of metal plates is exposed to the corrosive environment, the related art has not allowed the anti-corrosion method described above to be applied and thus satisfactory corrosion resistance to be ensured.

SUMMARY OF THE INVENTION

An object of the present invention is to provide a heat exchanger capable of ensuring the corrosion resistance of a fluid passage.

Another object of the present invention is to provide a heat exchanger capable of ensuring the corrosion resistance of one of two fluid passages.

Further objection of the present invention is to provide better heat exchange efficiency by disturbing a flow of cooling water.

One preferred mode of the present invention is to provide a heat exchanger including a plurality of metal plates having through-holes in the direction of plate thickness which are laminated to form a fluid passage by aligning the through-holes in the direction of lamination, a passage wall formed in said fluid passage and being exposed to a corrosive environment, wherein at least one of the plurality of metal plate has a protrusion projecting from the passage wall into the fluid passage and the protrusion is baser than the other part of the metal plate.

In another preferred mode of the present invention, the fluid passage includes at least a cooling water passage through which cooling water flows, and the protrusion is provided to be projected into the cooling water passage.

In further preferred mode of the present invention, the metal plate having the protrusion is made of an aluminum alloy material containing trace amount of at least magnesium and tin.

Thus, pitting corrosion progresses locally only at the protrusion, compared with the passage walls of other fluid passages, so that the passage walls of other fluid passages are prevented from being corroded.

DETAILED DESCRIPTION OF THE PREFERRED EMBODIMENTS

Figure 1:
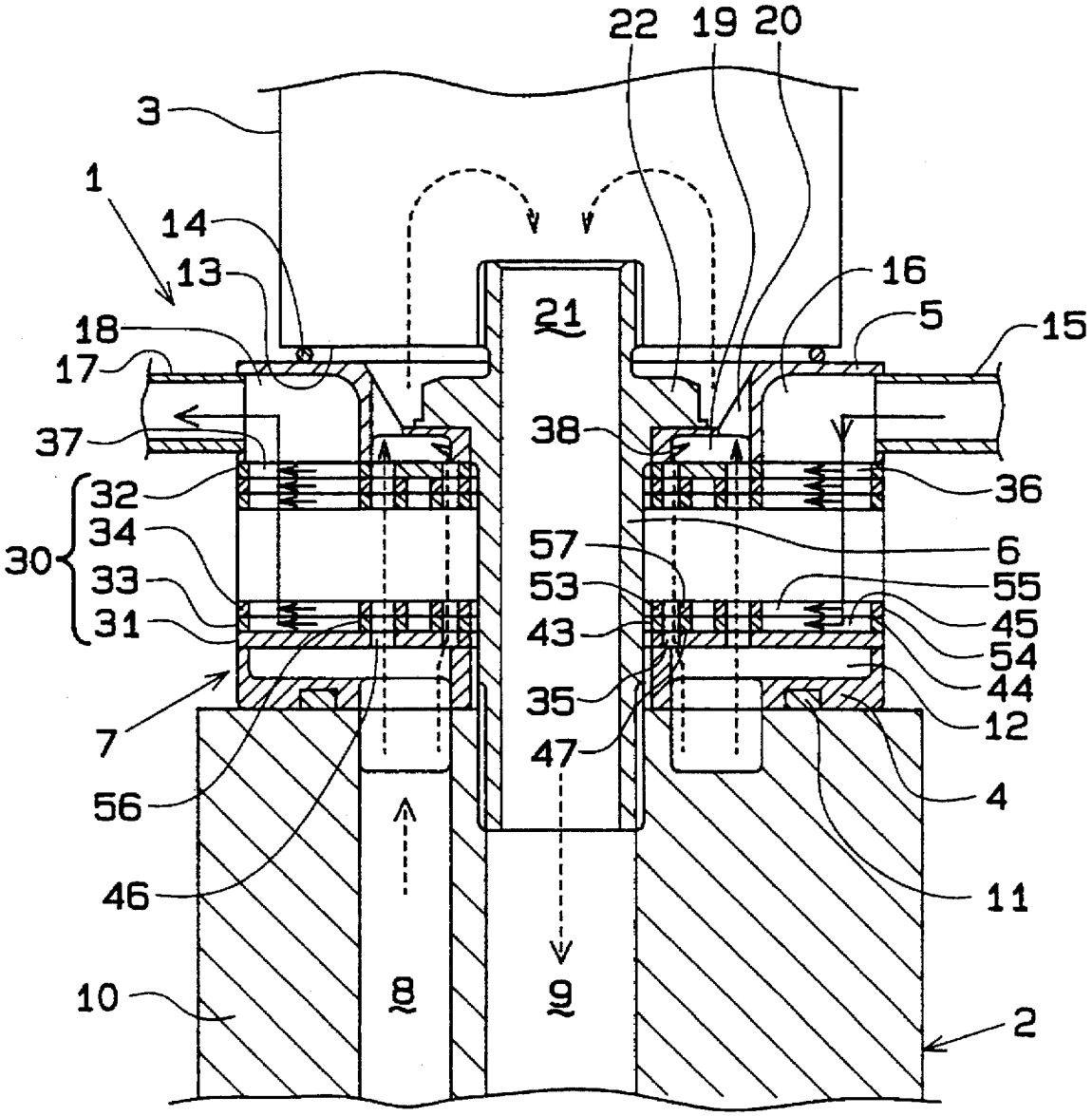
FIG. 1 is a partially cross-sectional view of a water-cooled oil cooler used as a first embodiment of the present invention.

Referring now to the drawings showing an water-cooled oil cooler, embodiments of a heat exchanger of the present invention are described.

[First Embodiment]

Figure 2:
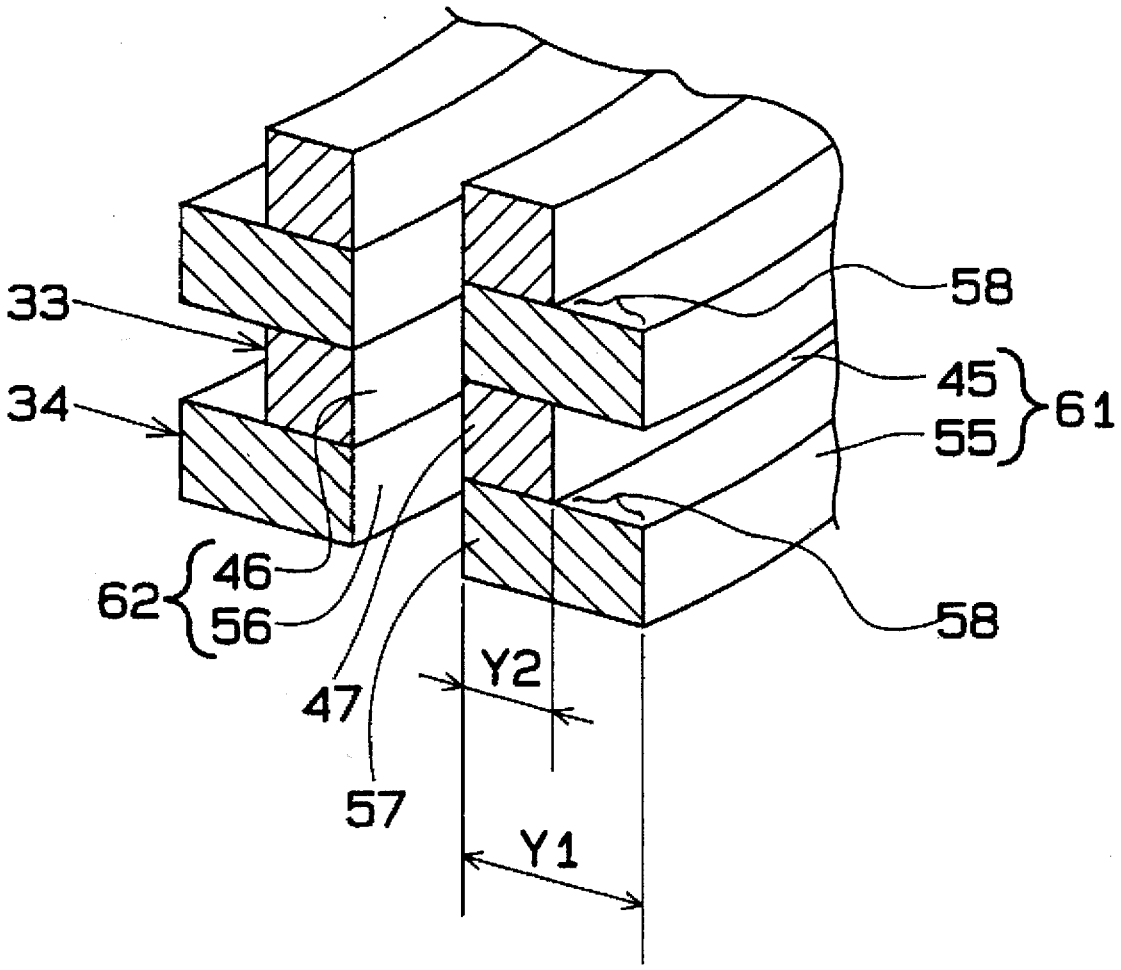
FIG. 2 is a partially cross-sectional view of showing an enlarged view of a part of laminated both the formed plate 33 and the fin plate 34 of the laminated body 30 of the heat exchanger of FIG. 1, FIGS. 3A and 3B are schematic explanatory view for fabricating the laminated body of FIG. 1, FIGS. 4A and 4B are schematic explanatory view for fabricating the laminated body of the water-cooled oil cooler used as a second embodiment of the present invention.

FIGS. 1 through 3 show a first embodiment of the present invention, FIG. 1 being a drawing illustrating a water-cooled oil cooler.

A water-cooled oil cooler 1, an example of a lamination-type heat exchanger, is installed between an engine 2 for vehicle driving and an oil filter 3. The water-cooled oil cooler 1 is provided with a lower-end bracket 4 to be attached to the engine 2, an upper-end bracket 5 to be fitted with an oil filter 3, a center bolt 6 of a cylindrical shape for supporting the oil filter 3, and a heat exchanging section 7 which is sandwiched between the lower-end bracket 4 and the upper-end bracket 5 to cool engine oil (hereinafter called oil) which is a non-corrosive fluid, by using engine cooling water (hereinafter called cooling water) which is a corrosive fluid.

The engine 2 is provided with a guiding passage 8 which leads oil, lubricating sliding sections (not shown), through the water-cooled oil cooler 1 to the oil filter 3 and an introducing passage 9 which introduces oil filtered by the oil filer 3 through the center bolt 6 into the engine.

The oil filter 3 has an already known cartridge-type structure into which a filtering element (not shown) filtering oil and a container are integrated.

The lower-end bracket 4, which is fabricated by forming, for example, an aluminum alloy material into a monolithic ring plate, has an O-ring 11 between the lower-end bracket 4 itself and a wall of a mounting block 10 for the engine 2 to prevent oil leakage. A plurality of oil inlet hole 12 communicating with the guiding passage 8 of the engine 2 are formed in the lower-end bracket 4.

The upper-end bracket 5, which is fabricated by forming, for example, an aluminum alloy material into a monolithic ring plate, has an O-ring 14 between the upper-end bracket 5 itself and wall of a mounting section 13 for the oil filter 3 to prevent oil leakage. A cooling water inlet passage 16 which introduces cooling water through a cooling water pipe 15 into the heat exchanging section 7 and a cooling water outlet passage 18 through which cooling water is fed from the heat exchanging section 7 to the cooing water pipe 17 are formed in the upper-end bracket 5.

The cooling water pipes 15 and 17 are connected to a cooling water circuit (not shown). A substantially circular oil outlet passage 19 is formed inside the cooling water inlet passage 16 and the cooling water outlet passage 18. The oil outlet passage 19 communicates with a plurality of oil outlet holes 20 for feeding oil from the heat exchanging section 7 to the oil filter 3.

The center bolt 6 provides a means for fastening the water-cooled oil cooler 1 to the wall of the mounting block 10 for the engine 2 and for fastening the oil filter 3 to the water-cooled oil cooler 1. A communicating passage 21 communicating the inside of the oil filter 3 with the introducing passage 9 of the engine 2 is formed in the center bolt 6. The center bolt 6 has a hexagonal section 22 in contact with the top surface of the upper-end bracket 5, tools such as a wrench fitting over the hexagonal section 22.

In the heat exchanging section 7, a laminated body 30 which cools oil by performing heat exchanges between cooling water and oil is sandwiched between one lower-end formed plate 31 and one upper-end formed plate 32.

The lower-end formed plate 31, which is fabricated by forming a metal plate, for example, 1.3 mm thick, made of an aluminum alloy material into a monolithic ring plate, is provided with a plurality of oil inlet openings 35 in the direction of plate thickness, which communicate with the plurality of oil inlet holes 12 of the lower-end bracket 4. The lower-end formed plate 31 has no cooling water passage.

The upper-end formed plate 32, which is fabricated by forming a metal plate, for example, 1.3 mm thick, made of an aluminum alloy material into a monolithic ring plate, is provided with a cooling water inlet opening 36 in the direction of plate thickness, which communicates with the cooling water inlet passage 16 of the upper-end bracket 5, and a cooling water outlet opening 37 in the direction of plate thickness, which communicates with the cooling water outlet passage 18 of the upper-end bracket 5. The upper-end formed plate 32 is provided with an oil outlet opening 38, which communicates with the oil outlet passage 19 of the upper-end bracket 5.

Figure 3A:
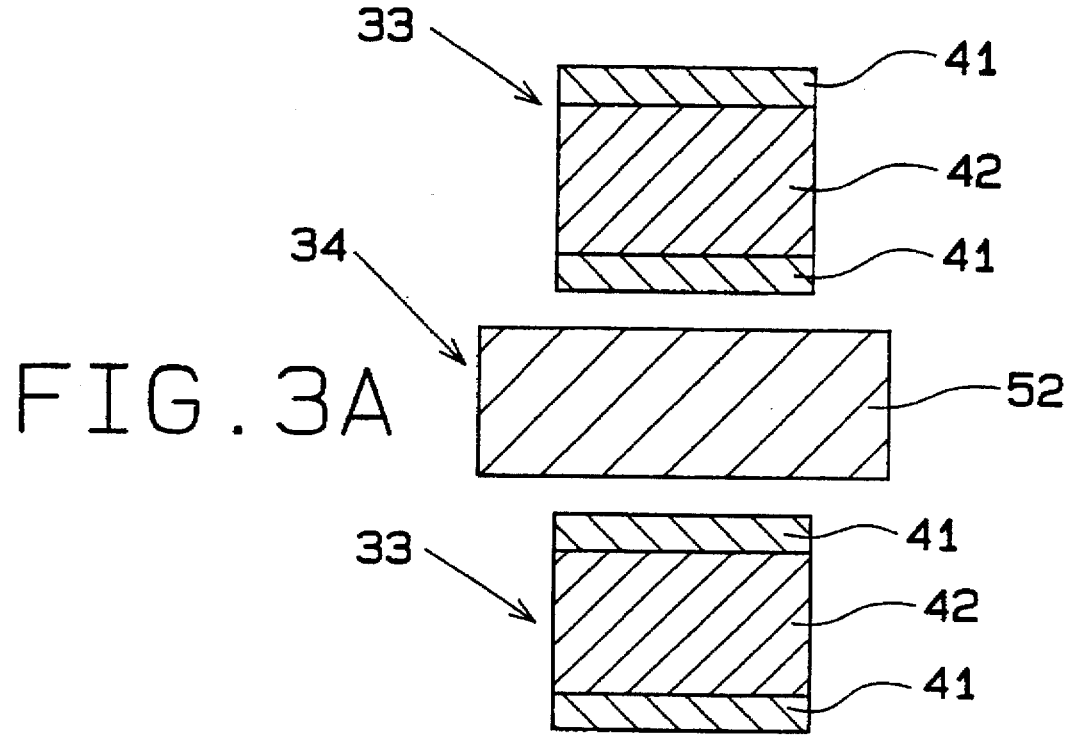

FIG. 2 shows an enlarged view of a part of laminated both the formed plate 33 and the fin plate 34 of the laminated body 30. The laminated body 30 is composed of a plurality of formed plates 33 and a plurality of fin plates 34, laminated in the direction of plate thickness. The formed plate 33 is fabricated by forming a brazing sheets into a monolithic ring plate. As shown in FIG. 3A, the brazing sheet consists of a core member 42 of a ring shape, which is made of an aluminum alloy material clad with an outer material 41, or an aluminum solder, at both end surfaces (joint surfaces).

The formed plate 33 has an inner wall 43 of a ring shape, fitted over the outer circumference of the center bolt 6, and an outer wall 44 which is provided around the inner wall 43 to form the outer shell of the water-cooled oil cooler 1. A plurality of cooling water passage openings 45, communicating with the cooling water inlet opening 36 and the cooling water outlet opening 37 of the upper-end formed plate 32, and a plurality of oil passage openings 46, communicating with a plurality of oil inlet openings 35 of the lower-end formed plate 31 and an oil outlet opening 38 of the upper-end formed plate 32, are provided between the inner wall 43 and the outer wall 44 in the direction of plate thickness.

A path wall 47 is formed between the cooling water passage opening 45 and the oil passage opening 46 as a means for partitioning these two openings.

The fin plate 34 which is an important characteristic of the present invention is fabricated by forming a metal plate into a monolithic ring plate, which is brazed between two formed plates 33 adjacent thereto to construct an inner fin. As shown in FIG. 3A, the above-described metal plate consists of a core member 52 of a ring shape, made of an aluminum alloy material.

The fin plate 34 has an inner wall 53 of a ring shape, fitted over the outer circumference of the center bolt 6, and an outer wall 54 which is provided around the inner wall 53 to form the outer shell of the water-cooled oil cooler 1. A plurality of cooling water passage openings 55, communicating with the plurality of cooling water flow openings 45 of the formed plates 33, and a plurality of oil passage openings 56, communicating with the plurality of oil passage openings 46 of the formed plates 33, are provided between the inner wall 53 and the outer wall 54 in the direction of plate thickness.

A path wall 57 is formed between the cooling water passage opening 55 and the oil passage opening 56 as a means for partitioning these two openings. A protrusion 58 is formed to be injected from the cooling water side surface of the path wall 57 into the cooling water passage opening 55. The protrusion 58 is set to be projected, for example, 0.5 mm from the cooling water side surface (inner surface) of the path wall 57. The number of fin plates 34 to be laminated can be set at will in the range from one to tens in accordance with the necessary heat radiation performance for the water-cooled oil cooler 1. The protrusion 58 can be provided over the entire inner circumference of the path wall 57 or along a segment of the inner circumference of the path wall 57 as long as the protrusion is along the cooling water passage opening 55. If Y1 and Y2 are respectively defined as the width of the fin plate 34 and the width of the formed plate 33 as shown in FIG. 2, the amount of the protrusion 58 is designed to be Y1>Y2, and the amount of the protrusion 58 must be set within the limit of ½ of the width of a cooling water passage 61 in accordance with the necessary life of the sacrificial corrosion section.

In the water-cooled oil cooler 1 of the embodiment, formed plates 33 and fin plates 34 are alternately laminated to form a plurality of cooling water passages 61 by aligning a plurality of cooling water passage openings 45 and a plurality of cooling water passage openings 55 in the direction of lamination. Similarly, a plurality of oil passages 62 are formed by aligning a plurality of oil passage openings 46 and a plurality of oil passage openings 56 in the direction of lamination. The cooling water passage 61 according to the present invention is one (first) fluid passage, and the oil passage 62 according to the present invention is the other (second) fluid passage.

[Method of fabricating the first embodiment]

Referring now to FIGS. 1 to 3, a method of fabricating the water-cooled oil cooler 1 of the embodiment is briefly described.

An aluminum alloy material containing 0.5 to 1.5 wt % manganese (Mn), 0.1 to 0.5 wt % copper (Cu), and 0.05 to 0.35 wt % titanium (Ti) is used as a material for core members 42 of formed plates 33 comprising the laminated body 30. The aluminum alloy material also contains less than 0.20 wt % silicon (Si) and less than 0.30 wt % iron (Fe) as impurities.

The aluminum alloy material can further or instead of titanium contain a highly corrosion-resistant metal material, such as chromium (Cr) or zirconium (Zr), in a proportion of 0.05 to 0.35 wt %.

An Al—Si aluminum alloy solder or an Al—Si—Mg aluminum alloy solder is used as the outer material 41.

A bear sheet (solid sheet) is used as the fin plate 34, a core member 52 of the bear sheet being made of an aluminum alloy material containing 0.5 to 1.5 wt % manganese (Mn), 0.03 to 0.8 wt % magnesium (Mg), and 0,005 to 0.10 wt % tin (Sn). The aluminum alloy material also contains less than 0.20 wt % silicon (Si) and less than 0.30 wt % iron (Fe) as impurities.

The formed plate 33, the fin plate 34, and the outer material 41 are 0.8 mm, 0.3 mm, and 0.08 mm thick, respectively, and the protrusion 58 of the fin plate 34 is projected 0.5 mm.

The lower-end formed plate 31 is first disposed, then the laminated body 30 formed by alternately piling up formed plates 33 and fin plates 34 is placed on the lower-end formed plate 31, and, finally, upper-end formed plates 32 are laminated on the laminated body 30 to loosely assemble the heat exchanging section 7. The heat exchanging section 7, sandwiched between the lower-end bracket 4 and the upper-end bracket 5, is heated at, for example, 600° C. in a vacuum oven (not shown) for five minutes and allowed to cool (vacuum brazing) gradually at room temperature to fabricate the water-cooled oil cooler 1.

Figure 3B:
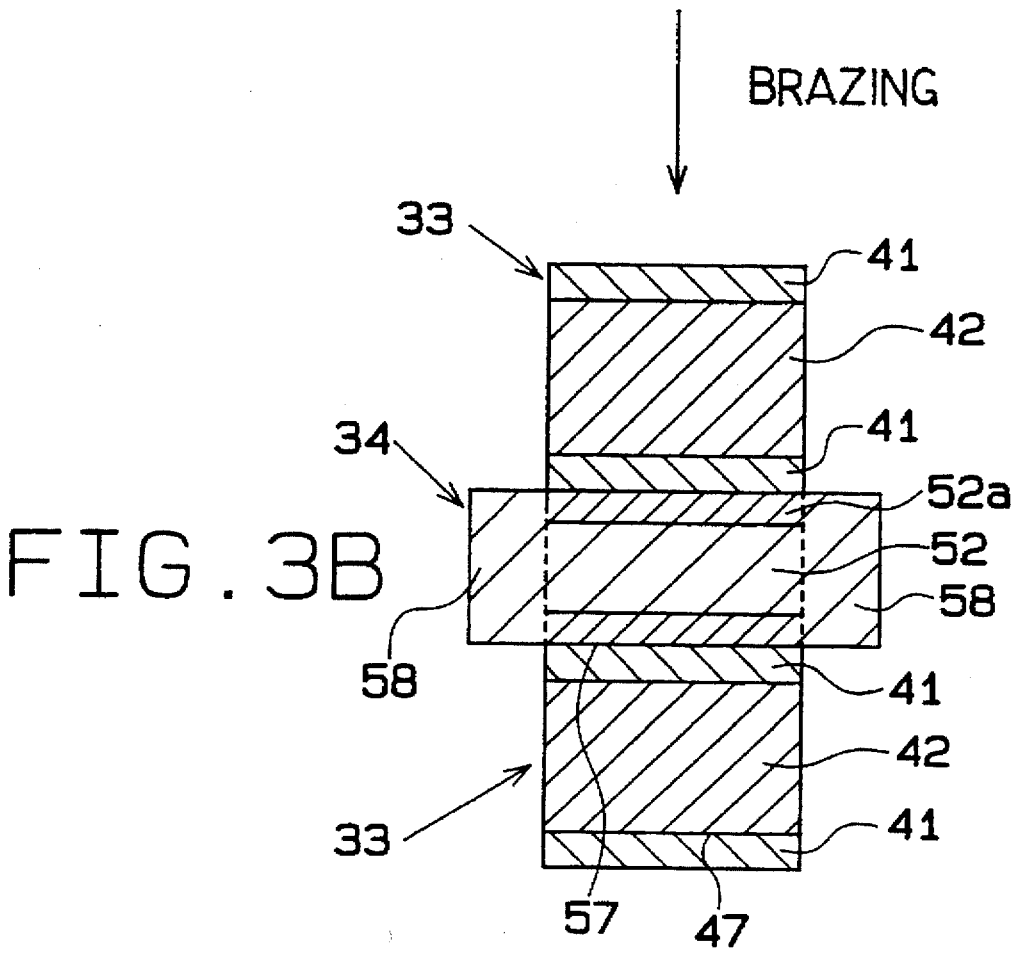

Referring now to FIG. 3B, the condition of the formed plate 33 and the fin plate 34 at the process of brazing is described. Although the fin plate 34 reacts with Mg and Sn contained in the core member 52 to form $Mg_2Sn$, the amount of $Mg_2Sn$ formed at the protrusion 58 is reduced by evaporating Mg in the protrusion 58 from the surface thereof by heating during vacuum brazing. Since this reduction causes aluminum alloy in the protrusion 58 to be Sn-richer than other passage walls 57 including connections with formed plates 33, so that Sn deposits on the surface of the protrusion 58 and the protrusion 58 becomes baser than that of other passage walls 57 so that only the protrusion 58 of the fin plate 34 becomes a sacrificial corrosion section. In other words, the protrusion 58 has a stronger ionization tendency than that of other passage walls 57.

In the embodiment, Cu in the core material 42 for the formed plate 33 is used to make the core member 42 noble, and moreover, diffusing Cu in the core material 42 during heating in vacuum brazing causes Cu to enter the eutectic in the connections of the core material 52 for the fin plate 34 and form a Cu diffusion layer 52*a*, making the connections of the core member 52 noble. Ti, Cr, or Zr, if contained in the core member 42 for the formed plate 33, improves the corrosion resistance of the core material 42. Since, therefore, the formed plate 33 and the fin plate 34 excluding the protrusion 58 thereof are prevented from being corroded as described above, the passage wall 47 of the formed plate 33 and the passage wall 57 of the fin plate 34 can be improved in corrosion resistance.

[Operation of the first embodiment]

Referring now to FIGS. 1 to 3, the operation of the water-cooled oil cooler of the embodiment is briefly described.

Oil for lubricating the sliding sections of the engine 2 flows through the introducing passage 8 of the engine 2 into the water-cooled oil cooler 1, proceeds from the plurality of oil inlet holes 12 of the lower-end bracket 4 to the plurality of oil inlet holes 35 of the lower-end formed plate 31, passes through the plurality of oil passages 62 of the laminated body 30 to the plurality of oil passage openings 46 of the formed plate 33, and leaves the laminated body 30 at the oil outlet openings 38 of the upper-end formed plate 32.

The oil, when passing through the plurality of oil passages 62 of the laminated body 30, is cooled by heat exchange between the oil and cooling water. The cooled oil goes to oil passages 19 of the upper-end bracket 5 and passes through the plurality of oil outlet holes 20 into the oil filter 3, and undergoes filtering when flowing through the filtering element. The filtered oil flows from the oil filter 3 into the communicating passage 21 of the center bolt 6, passes through the introducing passage 9 of the engine 2, and feeds to the sliding sections of the engine 2.

On the other hand, cooling water flows from a cooling water pipe 15 into the water-cooled oil cooler 1, proceeds from the cooling water inlet passage 16 of the upper-end bracket 5 to the cooling water inlet opening 36 of the upper-end formed plate 32, and passes through the plurality of cooling water passages 61 of the laminated body 30, and leaves the laminated body 30 at the cooling water outlet opening 37 of the upper-end formed plate 32.

Cooling water exchanges heat with oil when passing through the plurality of cooling water passages 61 of the laminated body 30. After heat exchange with oil, cooling water flows through the cooling water outlet passage 18 of the upper-end bracket 5 into a cooing water pipe 17 and feeds to a radiator or the water jacket of the engine 2.

Advantage of the first embodiment

When the water-cooled oil cooler 1 is used for prolonged periods of time, cooling water, a corrosive fluid, is likely to cause pitting corrosion at the passage walls 47 and 57 of the plurality of cooling water passages 61 of the laminated body 30 formed from an aluminum alloy material.

Since, however, the water-cooled oil cooler 1 in the embodiment has the formed plate 33 and the fin plate 34 excluding the protrusion 58 thereof prevented from being corroded, as described above, when the laminated body 30 is fabricated, only the protrusion 58 projecting into the cooling water passage 61 of the fin plate 34 is mainly exposed to the corrosive environment.

As a result, the passage wall 47 of the formed plate 33 and the passage wall 57 of the fin plate 34, particularly the contact between the formed plate 33 and the fin plate 34, are improved in corrosion resistance, thus preventing cooling water and oil from being mixed together and cooling water from leaking out of the water-cooled oil cooler 1.

The protrusion 58 formed in a passage of cooling water disturbs the flow of cooling water. Consequently, heat exchange efficiency between cooling water and oil is improved.

[Method for fabricating the second embodiment]

Figure 4A:
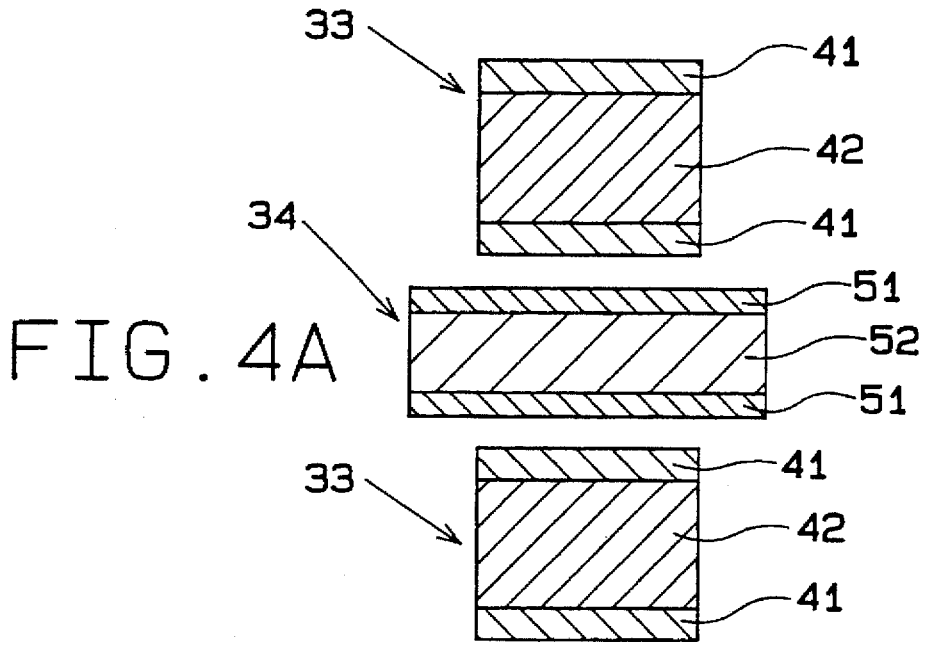
Figure 4B:
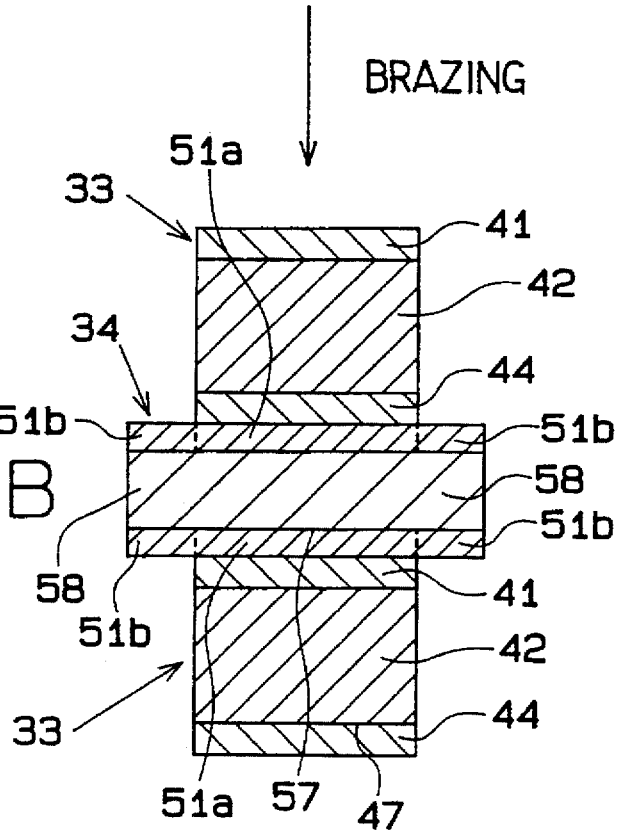

FIGS. 4A and 4B, a drawing illustrating a procedure for fabricating the laminated body 30 of the water-cooled oil cooler, shows a second embodiment of the present invention.

The fin plate 34 in the embodiment is fabricated by forming a brazing sheet into a monolithic ring plate. As shown in FIGS. 4A and 4B, the brazing sheet consists of a core member 52 of a ring shape, which is made of an aluminum alloy material clad with an outer material 51, or an aluminum solder, at both end surfaces (joint surfaces).

An aluminum alloy material containing 0.5 to 1.5 wt % manganese (Mn), 0.1 to 0.5 wt % copper (Cu), and 0.05 to 0.35 wt % titanium (Ti) is used as a material for a core member 52 for a fin plate 34. The aluminum alloy material also contains less than 0.20 wt % silicon (Si) and less than 0.30 wt % iron (Fe) as impurities.

The aluminum alloy material can further or instead of titanium contain a highly corrosion-resistant metal material, such as chromium (Cr) or zirconium (Zr), in a proportion of 0.05 to 0.35 wt %.

An aluminum alloy material containing 0.5 to 1.5 wt % manganese (Mn), 0.05 to 0.20 wt % copper (Cu), and 0.005 to 0.1 wt % indium (In) is used as a outer material 51. The aluminum alloy material also contains less than 0.20 wt % silicon (Si) and less than 0.30 wt % iron (Fe) as impurities.

The core members 42 and 52 are 1.3 mm thick, the outer members 41 and 51 are 0.13 mm thick, and the protrusion 58 of the fin plate 34 is projected 0.5 mm.

Referring now to FIG. 4B, the condition of the formed plate 33 and the fin plate 34 at the process of brazing is described. The laminated body 30 in the embodiment is brazed in vacuum oven as in the first embodiment to joint the formed plate 33 and the fin plate 34.

Cu in the core material 42 for the formed plate 33 is used to make the core member 42 noble, and moreover, diffusing Cu in the core material 42 during heating in vacuum brazing causes Cu to enter the eutectic in the connections of the core material 42 so that the connections of the formed plate 33 become noble. Diffusing Cu in the outer material 51 for the fin plate 34 during heating in vacuum brazing causes Cu to enter the eutectic in the connections of the outer material 51 and form a Cu diffusion layer 51*a*, making the connections of the fin plate 34 noble.

Conversely, indium in the outer material 51 for the fin plate 34 causes only the protrusion 58 of the outer material 52 to make baser in the laminated body 30, and thus only the protrusion 58 serves as a sacrificial corrosion member. Since, therefore, the contact between the formed plate 33 and the fin plate 34 can be protected from preceding corrosion by using as a sacrificial corrosion layer only an outer material 51*b* for the protrusion 58 of the fin plate 34 the passage wall 47 of the formed plate 33 and the passage wall 57 of the fin plate 34 can be increased in corrosion resistance.

Results of comparison between the first and second embodiments of the present invention and conventional embodiment A test is described below which was performed, using test pieces arranged according to the first and second embodiments of the present invention and a test piece according to a conventional embodiment, to investigate the maximum depth of corrosion at the connection of the formed plate 33.

Figure 5:
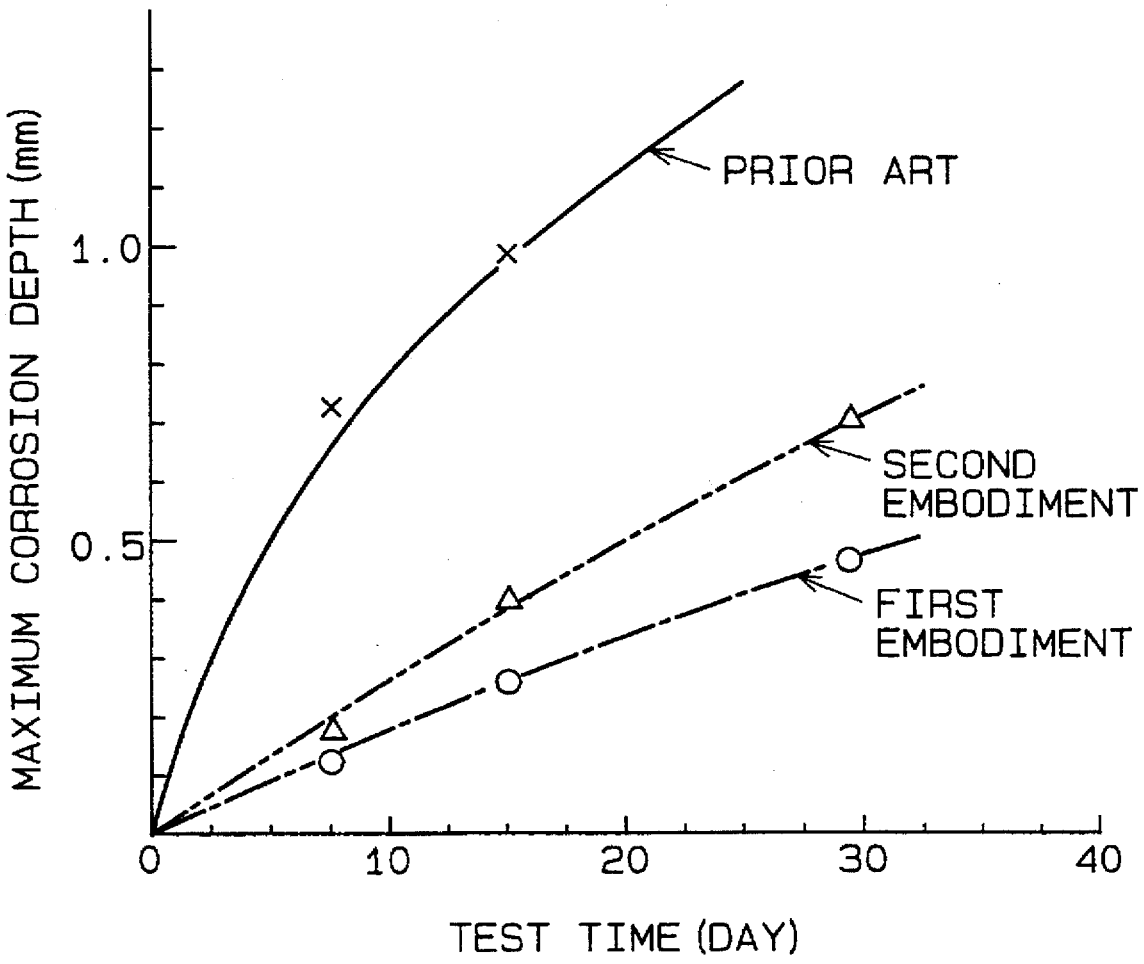
FIG. 5 is a graph showing the results of an immersion test performed on the embodiments of the present invention and a conventional example.

In this immersion test, test pieces which were heated at 600° C. in a vacuum oven for five minutes and then allowed to cool gradually at room temperature were immersed in solutions at a $Cl^{31}$ concentration of 300 ppm, a $SO_4^{2-}$ concentration of 100 ppm, and a $Cu^{2+}$ concentration of 10 ppm to investigate the maximum depth of corrosion at the connection of the formed plate 33, the results being shown in FIG. 5. In the immersion test, the test pieces also underwent about 30 thermal cycles comprising the steps of 16 hours of immersion in the solutions at 88° C. and 8 hours of cooling at room temperature.

As can be ascertained from the graph of FIG. 5, the test piece arranged according to the conventional embodiment exhibited pits (corrosion) penetrating the formed plate 25 days after the test was started, while the depth of pits (corrosion) in the test pieces arranged according to the first and second embodiments of the present invention was no more than half the test piece thickness (1.3 mm). It is therefore found that corrosion progresses more slowly for the first and second embodiments than for the conventional embodiment free from any protrusion 58, thus resulting in increased product durability.

[Modification]

In the embodiment, the present invention is applied to the water-cooled oil cooler 1; however, the present invention can be applied to heat exchangers, such as hot-water heater cores and radiators.

The shape of the protrusion (projection) can optionally be changed to a polygon, a circle, or an oval. The protrusion (projection) 58 can be thinner than the fin plate 34.

[Advantage of the invention]

The present invention allows the corrosion resistance of flow path walls exposed to the corrosive environment to be ensured. The protrusion 58 disturbs the flow of cooling water and heat exchange efficiency is improved. Further, the present invention allows the corrosion resistance of the passage wall of a cooling water passage, exposed to the corrosive environment, to be ensured. And further, the present invention allows the corrosion resistance of the passage wall of one of two fluid passages, exposed to the corrosive environment, to be ensured.

What is claim:

1. A heat exchanger comprising:

a plurality of metal plates having through-holes in the direction of plate thickness which are laminated to form a fluid passage through said through-holes in the direction of lamination; and a passage wall formed by an edge of each of said plates of said through-holes in said fluid passage and being exposed to a corrosive environment, wherein at least one of said plurality of metal plates has a protrusion on said edge projecting from said passage wall into said fluid passage further than said edge of an adjacent one of said plates and said protrusion has a stronger ionization tendency than the other part of said metal plate.

2. The heat exchanger according to claim 1, wherein said fluid passage comprises at least a cooling water passage through which cooling water flows, and said protrusion is provided to be projected into said cooling water passage.

3. The heat exchanger according to claim 1, wherein said metal plate having said protrusion is made of an aluminum alloy material containing trace amount of at least magnesium and tin.

4. The heat exchanger according to claim 2, wherein said metal plate having said protrusion is made of an aluminum alloy material containing trace amount of at least magnesium and tin.

5. A heat exchanger comprising:

a plurality of metal plates each having at least two through-holes in the direction of plate thickness which are laminated to form a first fluid passage through one of said two through-holes in the direction of lamination and to form a second fluid passage by aligning second edges of the other of said two through-holes in the direction of lamination;

a corrosive fluid flowing through said first fluid passage;

a non-corrosive fluid flowing through said second fluid passage to exchange heat with said corrosive fluid; and a passage wall formed by a first edge of each of said plates in said first fluid passage and being exposed to a corrosive environment, wherein at least one of said plurality of metal plates has a protrusion on said first edge projecting from said passage wall into said first fluid passage further than said first edge of an adjacent one of said plates and said protrusion has a stronger ionization tendency than the other part of said metal plate.

6. The heat exchanger according to claim 5, wherein said first fluid passage comprises at least a cooling water passage through which cooling water flows, and said protrusion is provided to be projected into said cooling water passage.

7. The heat exchanger according to claim 5, wherein said metal plate having said protrusion is made of an aluminum alloy material containing trace amount of at least magnesium and tin.

8. The heat exchanger according to claim 6, wherein said metal plate having said protrusion is made of an aluminum alloy material containing trace amount of at least magnesium and tin.

* * * * *